US009490565B2

(12) United States Patent
Beck et al.

(10) Patent No.: US 9,490,565 B2
(45) Date of Patent: Nov. 8, 2016

(54) ELECTRICAL CONTACT WITH SEALING WEB

(71) Applicant: Tyco Electronics AMP GmbH, Bensheim (DE)

(72) Inventors: Karl Beck, Langen (DE); Michael Spielvogel, Bad Duerkheim (DE); Daniel Rosan, Buerstadt (DE); Thomas Schmitt, Moerfelden-Walldorf (DE)

(73) Assignee: TE CONNECTIVITY GERMANY GMBH, Bensheim (DE)

( * ) Notice: Subject to any disclaimer, the term of this patent is extended or adjusted under 35 U.S.C. 154(b) by 0 days.

(21) Appl. No.: 14/394,096

(22) PCT Filed: Apr. 8, 2013

(86) PCT No.: PCT/EP2013/057322
§ 371 (c)(1),
(2) Date: Oct. 12, 2014

(87) PCT Pub. No.: WO2013/153038
PCT Pub. Date: Oct. 17, 2013

(65) Prior Publication Data

US 2015/0118903 A1 Apr. 30, 2015

(30) Foreign Application Priority Data

Apr. 13, 2012 (DE) ..... 10 2012 206 035

(51) Int. Cl.
*H01R 9/05* (2006.01)
*H01R 13/41* (2006.01)
*H01R 13/52* (2006.01)

(52) U.S. Cl.
CPC ..... *H01R 13/41* (2013.01); *H01R 13/521* (2013.01); *H01R 13/5216* (2013.01)

(58) Field of Classification Search
CPC H01R 13/41; H01R 13/521; H01R 13/5216; H01R 13/4367; H01R 13/53; H01R 24/28
USPC ..... 439/588
See application file for complete search history.

(56) References Cited

U.S. PATENT DOCUMENTS 5,000,695 A 3/1991 Nishiyama et al.
5,017,160 A * 5/1991 Garcia ..... E21B 17/028 439/271

(Continued)

FOREIGN PATENT DOCUMENTS

EP 0574862 A2 12/1993
WO WO 2008/075802 A1 6/2008
WO WO 2009/143123 A2 11/2009

OTHER PUBLICATIONS

International Search Report and Written Opinion issued by the European Patent Office dated Apr. 22, 2013, for International Application No. PCT/EP2013/057322; 10 pages.

*Primary Examiner* — Jean F Duverne
(74) *Attorney, Agent, or Firm* — Faegre Baker Daniels LLP

(57) ABSTRACT

Electrical contact (19) having a housing (2) in which an electrical conductor (1) is embedded, the housing (2) having a recess (3), the electrical conductor (1) being inserted into the recess (3), an intermediate space (20) between the conductor (1) and the housing (2) being filled with a sealing material (21), the conductor (1) extending in the longitudinal direction through the housing (2), the conductor (1) having a web (15, 16), the web (15, 16) extending transversely relative to the longitudinal direction around the conductor (1), the web (15, 16) protruding by a predetermined height beyond a lateral face (6, 7) of the conductor (1), the sealing material (21) being arranged at one side of the web (15, 16).

22 Claims, 3 Drawing Sheets

(56) References Cited

U.S. PATENT DOCUMENTS 5,178,547 A * 1/1993 Bonas et al. ..... 439/34
5,795,170 A * 8/1998 Okabe ..... 439/252
5,885,114 A 3/1999 Akeda et al.
6,073,963 A * 6/2000 Hamilton et al. ..... 280/741
6,527,592 B2 * 3/2003 Mochizuki et al. ..... 439/660
2007/0184701 A1 * 8/2007 Yagome ..... H01R 13/506 439/271

* cited by examiner

ELECTRICAL CONTACT WITH SEALING WEB

The invention relates to an electrical contact according to patent claim 1.

In the prior art, there are known electrical contacts in which an electrical conductor is inserted into a plastics housing. An object of the invention is to provide an improved electrical contact.

The object of the invention is achieved by the electrical contact according to patent claim 1.

Other advantageous embodiments of the invention are set out in the dependent claims.

An advantage of the electrical contact described is that sealing material which is provided to seal an intermediate space between the electrical conductor and the housing is securely retained in a fixed region of the housing. This is achieved by the electrical conductor having a web which is arranged transversely relative to a longitudinal direction of the conductor and which protrudes by a predetermined height above a side face of the electrical conductor. Consequently, in the assembled state of the conductor, the web abuts the housing so that a flow blocking member for the sealing material is produced by means of the web. Owing to the formation of the web, on the one hand, a flow blocking member is produced and, on the other hand, owing to the free space between the conductor and the housing, simple and reliable assembly of the conductor in the housing is possible. In addition, the sealing material can be introduced into the free space, that is to say, in the intermediate space between the conductor and the housing.

The web preferably protrudes to such an extent beyond the lateral face of the conductor that the web abuts a wall of the housing in a sealing manner.

In another embodiment, the conductor has four lateral faces, a web being arranged on each of the four lateral faces, respectively. In this manner, it is possible to apply sealing material to four lateral faces of the conductor, without the sealing material being able to flow into inadmissible regions. Owing to the formation of the webs on the lateral faces of the conductor, a sealing of the intermediate space in the conducting housing is possible at all four lateral faces of the conductor, without the sealing material being able to flow beyond the regions delimited by the webs. Consequently, reliable and fluid-tight embedding of the conductor in the housing is enabled.

In another embodiment, two identical webs are formed at two opposing lateral faces, respectively, the two types of web being constructed differently. In this manner, the type of webs can be adapted to the width of the lateral face. Tests have shown that webs which protrude to a relatively large extent beyond the lateral face on narrow lateral faces are hardly disadvantageous for the assembly and the function of the electrical contact. Consequently, on the narrow lateral faces, webs which protrude further from the lateral face can be provided. Furthermore, tests have shown that the webs on the wider lateral faces are not intended to extend too far beyond the lateral face of the conductor since assembly is otherwise made more difficult. The webs preferably protrude on the wider lateral faces to such an extent beyond the lateral faces that the webs in the assembled state of the conductor touch the associated inner walls of the housing. Depending on the embodiment selected, in the assembled state there may also be a small spacing between the webs of the wide lateral faces and the associated housing walls. Depending on the viscosity of the sealing material, in spite of the spacing of the web from the lateral wall of the housing, the sealing material is prevented from flowing past the web.

In another embodiment, the conductor has a groove parallel with the construction of the web. The combination of the web and groove forms an improved flow resistance for the sealing material. In addition, owing to the formation of the groove at the side of the web in the sealing region, that is to say, on the web, a particularly thick layer of sealing material is introduced. Consequently, improved sealing is achieved which in particular ensures improved sealing against impediments such as impacts, temperature fluctuations, deviations from standard geometries.

In another embodiment, an electrical conductor has a groove at both sides of the web.

In another embodiment, the groove has two lateral faces, the lateral faces being arranged substantially parallel with the longitudinal extent of the web, that is to say, transversely relative to the longitudinal direction of the conductor. The two lateral faces of the groove have different inclinations relative to the lateral face of the conductor. The lateral face of the groove which is adjacent to the web has a shallower inclination than the lateral face directed away from the web. In this manner, improved influx and filling of the groove with sealing material are enabled. In addition, the sealing is improved by the special configuration of the lateral faces of the groove.

In another embodiment, the flatter lateral face of the groove has a larger width than the steeper lateral face of the groove.

In another embodiment, the two lateral faces of the groove have an opening angle between 50° and 80°, for example 65°, in a direction perpendicular relative to the groove. This opening angle of the groove leads, on the one hand, to good filling of the groove with sealing material and, on the other hand, to reliable and robust sealing of the intermediate space between the conductor and the housing.

The invention is explained in greater detail with reference to the Figures, in which.

Figure 1:
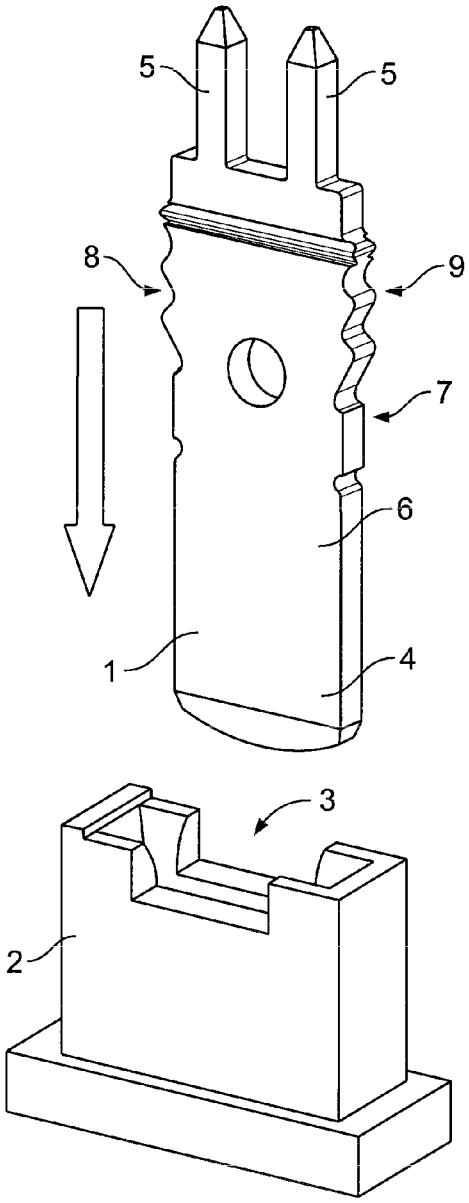
FIG. 1 shows a housing and an electrical conductor prior to the assembly.

FIG. 1 is a perspective view of an electrical conductor 1 and a housing 2, the housing 2 having a recess 3 for receiving the electrical conductor 1. The housing 2 is, for example, formed from a plastics material. The electrical conductor 1 is, for example, produced as a punched component from a metal sheet and has a contact tongue 4 at a first end and contact pins 5 at the opposing second end. In the embodiment illustrated, the conductor 1 is of a rectangular cross-section. In addition, the conductor 1 is of an elongate strip form, two wide lateral faces, that is to say, an upper side 6 and a lower side 7, being opposite each other in a parallel manner. At the sides of the upper side and the lower side 6, 7, there are formed narrow lateral faces 8, 9 which are arranged parallel with each other.

The webs 15, 16 and the grooves 17, 18 are preferably introduced into the conductor 1 by means of a pressing operation.

Figure 2:
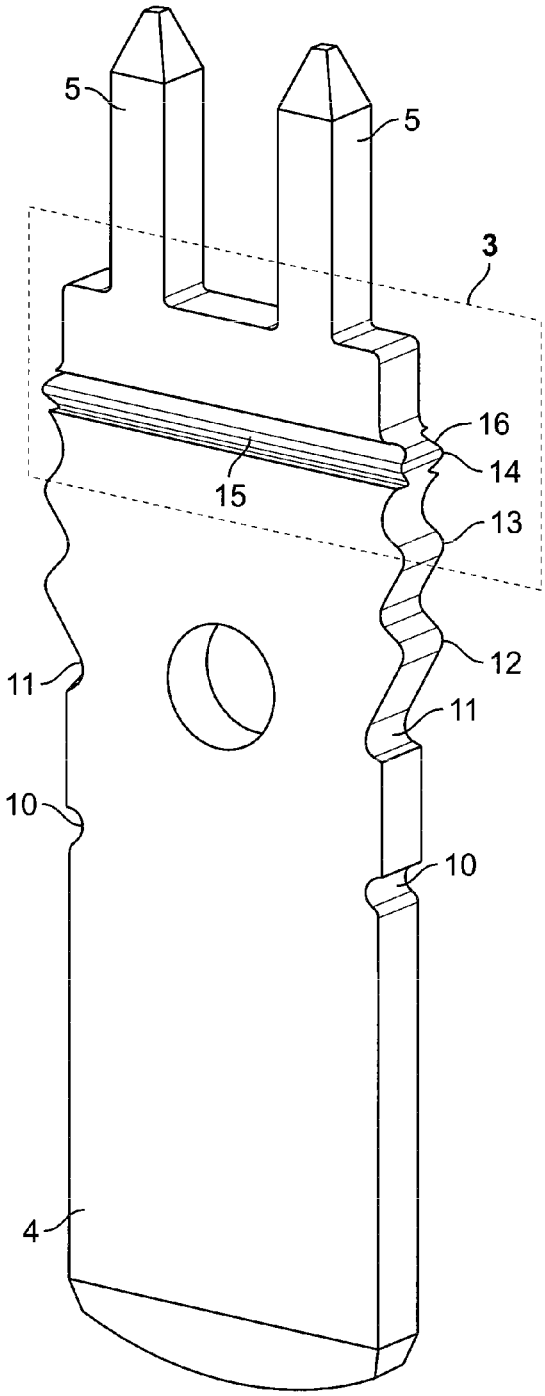
FIG. 2 is an enlarged illustration of a portion of the conductor.

FIG. 2 is an enlarged view of the conductor.

The width of the contact tongue 4 is constant as far as the central region of the conductor 1. In a central region of the conductor 1, the lateral faces 8, 9 have a first recess 10. In the direction towards the contact pins 5, there follows with a fixed spacing relative to the first recess 10 a second recess 11 in the lateral faces 8, 9. Adjacent to the second recess 11, there follow two catch projections 12, 13. After the second catch projection 13, with spacing in the direction towards the contact pins 5, there follows a third catch projection 14 which is also formed on the first and second lateral face 8, 9. The first and the second catch projections 12, 13 serve to lock the conductor 1 in the housing 2. The first and second lateral faces 8, 9 are constructed in an identical manner. At the height of the third catch projection 14, a web 15, 16 is formed on the upper and lower side 6, 7, respectively. The third catch projections 14 of the two lateral faces 8, 9 and the first and second webs 15, 16 of the upper and lower side 6, 7 which are arranged at the same height form a flow blocking member which is arranged so as to extend around the conductor 1.

Figure 3:
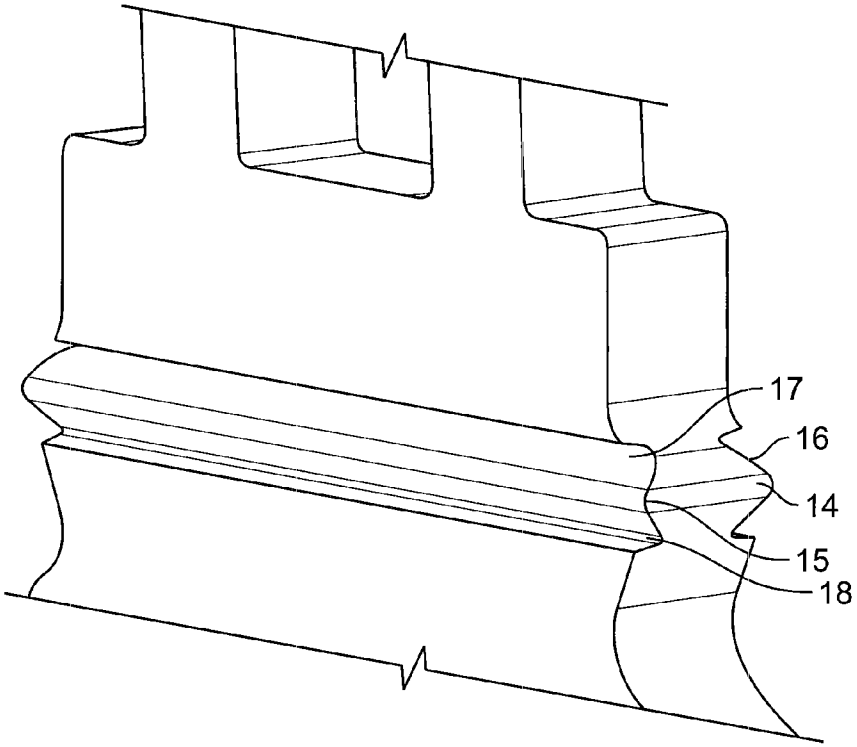
FIG. 3 is a cutout of the conductor of FIG. 2.

FIG. 3 is an enlarged view of the cutout of the conductor 1 in the region of the webs 15, 16 and the third catch projections 14. In the embodiment illustrated, a first or a second groove 17, 18 is formed at both sides of each web 15, 16 in the upper side 6 and in the lower side 7.

Figure 4:
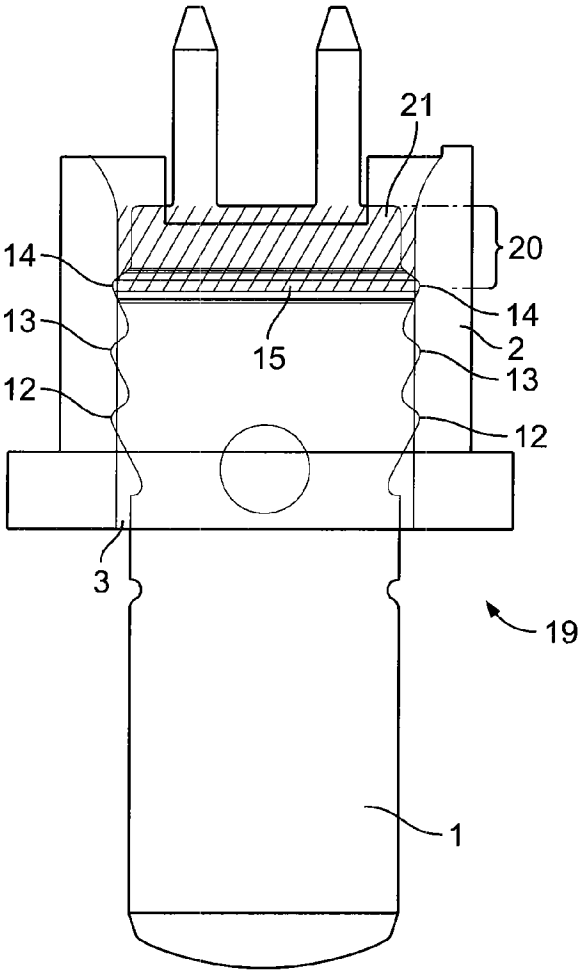
FIG. 4 is a cross-sectional illustration of the electrical contact.

FIG. 4 is a cross-section through an electrical contact 19, in which the conductor 1 is mounted in the housing 2 and sealing material 21 is further introduced into the housing 2 in a portion 20 of the recess 3. The sealing material 21, owing to the webs 15, 16 and the third catch projections 14, can flow only as far as the webs 15, 16. Consequently, only an upper portion 20 of the recess 3 is filled with sealing material 21.

In FIG. 4, the engagement of the catch projections 12, 13, 14 in correspondingly narrow lateral walls of the recess 3 of the housing 2 can clearly be seen.

Figure 5:
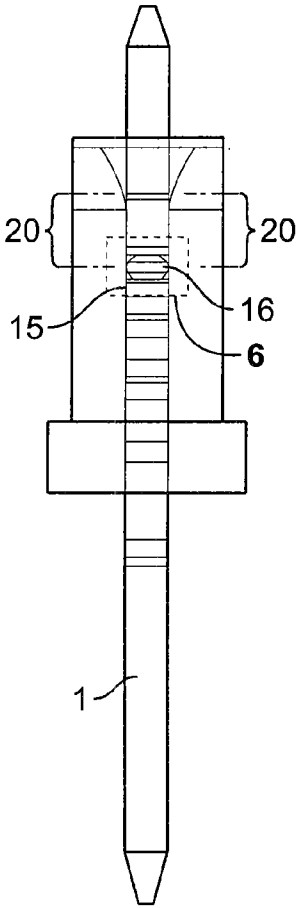
FIG. 5 is a second cross-sectional illustration of the electrical contact.

FIG. 5 is another cross-section through the arrangement of FIG. 4. It can clearly be seen that the webs 15, 16 abut the associated lateral walls of the recess 3 of the housing 2.

Figure 6:
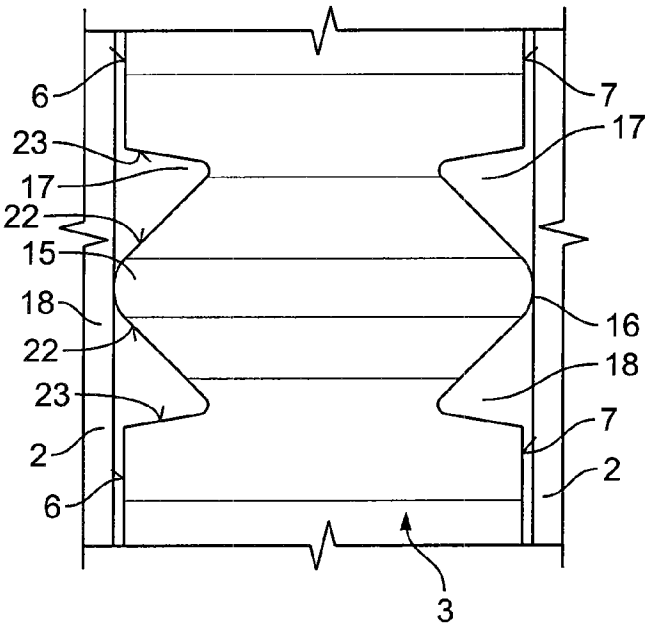
FIG. 6 is an enlarged partial cutout of FIG. 5.

FIG. 6 is an enlarged illustration of the region of the webs 15, 16 of FIG. 5. In this instance, the protrusion of the webs 15, 16 beyond the upper side 6 and lower side 7 of the conductor 1 can clearly be seen, respectively.

Figure 7:
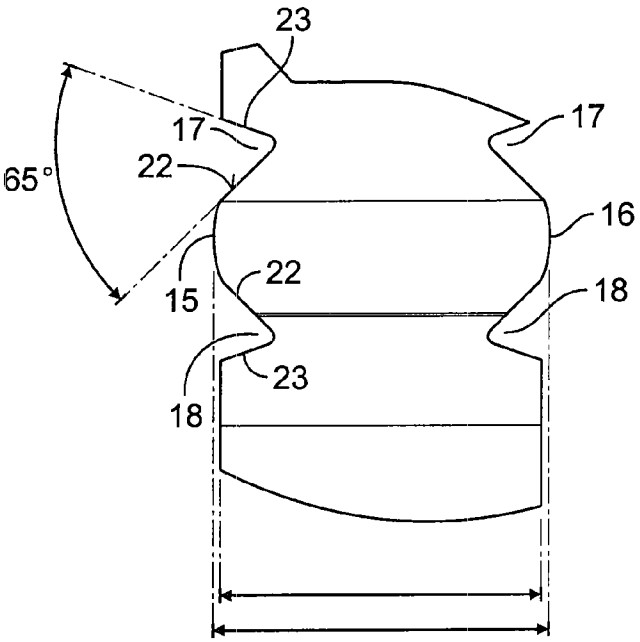
FIG. 7 is an enlarged cross-section through the electrical conductor.

FIG. 7 is a schematic illustration of a cutout of the conductor 1.

With reference to FIG. 7, it can be seen that the grooves 17, 18 are arranged parallel with the transverse extent of the webs 15, 16. In addition, the grooves 17, 18 have differently inclined first and second groove faces 22, 23 perpendicularly relative to the webs 15, 16. The opening angle of the groove faces 22, 23 may be in a range between 50 and 80 degrees, for example, 65 degrees. The first groove face 22 which faces the respective web 15, 16 has a smaller inclination than the second groove face 23 with respect to a longitudinal axis of the conductor 1. In this manner, both improved filling of the groove is achieved and more robust sealing is enabled.

Depending on the embodiment selected, it is also possible to dispense with the grooves 17, 18. In addition, the grooves may have groove faces which are arranged at different cross-sections, for example, symmetrically.

As a sealing material, it is possible to use, for example, liquid adhesive or hot-melt adhesive.

In addition, instead of the two contact pins 5, only one contact pin or another shape of the contact may also be provided.

The angle of inclination of the second groove face 23 is in the range between 90° and 130° with respect to a line perpendicular to the upper side 6. In addition, the angle of inclination of the first groove face 22 may be between 150° and 100° with respect to a line perpendicular to the upper side 6.

The webs 15, 16 preferably have in a sealing region, which abuts the housing 2, a rounded contour in cross-section perpendicularly relative to the longitudinal extent of the respective web 15, 16. Reliable and robust sealing with respect to the housing is thereby achieved.

The webs 15, 16 protrude by, for example, from 1% to 15% of the thickness of the conductor from the upper side 6 or lower side 7.

The invention claimed is:

1. An electrical contact having a housing in which an electrical conductor is embedded, wherein the housing has a recess defining at least one internal surface of the housing, the electrical conductor being inserted into the recess, the conductor extending in the longitudinal direction through the housing, the conductor having a web, the web extending transversely relative to a longitudinal direction of the conductor, the web protruding by a predetermined height beyond a side of the conductor and contacting the at least one internal surface, the sealing material being arranged at only one side of the web in an intermediate space extending from the web and between the conductor and the housing.

2. The electrical contact according to claim 1, wherein the conductor has four lateral faces, a web being arranged on the four lateral faces, respectively.

3. The electrical contact according to claim 2, wherein two opposing lateral faces are arranged parallel with each other, the webs of opposing lateral faces being constructed in an identical manner.

4. The electrical contact according to claim 3, wherein the webs of the two narrower lateral faces protrude further from the lateral face than the webs of the wider lateral faces.

5. The electrical contact according to claim 1, wherein the web has a groove at least at one side, the groove being constructed parallel with the web.

6. The electrical contact according to claim 5, wherein a groove is arranged at two sides of the web, respectively.

7. The electrical contact according to claim 6, wherein the web protrudes beyond the lateral face in the range from 1% to 10% of a thickness of the conductor.

8. The electrical contact according to claim 5, wherein the groove has two lateral faces, the lateral faces being arranged transversely relative to the longitudinal direction of the conductor, the lateral faces having different inclinations, the lateral face which is associated with the web having a shallower inclination defining a flatter lateral face and an opposing steeper lateral face.

9. The electrical contact according to claim 8, wherein the flatter lateral face has a larger width than the steeper lateral face.

10. The electrical contact according to claim 5, wherein lateral faces of the groove have an opening angle between 50° and 80°, in a plane perpendicular relative to the groove.

11. The electrical contact according to claim 10, wherein lateral faces of the groove have an opening angle of approximately 65°, in a plane perpendicular relative to the groove.

12. An electrical contact, comprising:

a housing having a recess defining an insertion face;

an electrical conductor inserted through the insertion face and embedded into the recess, the conductor extending in the longitudinal direction through the housing, the conductor having a web integral with the conductor, the web extending transversely relative to a longitudinal direction of the conductor and protruding by a predetermined height beyond a side of the conductor; and sealing material positioned in the recess and being arranged in an intermediate space extending from the conductor web to a position adjacent the insertion face.

13. The electrical contact according to claim 12, wherein the conductor has four lateral faces, a web being arranged on the four lateral faces, respectively.

14. The electrical contact according to claim 13, wherein two opposing lateral faces are arranged parallel with each other, the webs of opposing lateral faces being constructed in an identical manner.

15. The electrical contact according to claim 14, wherein the webs of the two narrower lateral faces protrude further from the lateral face than the webs of the wider lateral faces.

16. The electrical contact according to claim 12, wherein the web has a groove at least at one side, the groove being constructed parallel with the web.

17. The electrical contact according to claim 16, wherein a groove is arranged at two sides of the web, respectively.

18. The electrical contact according to claim 17, wherein the web protrudes beyond the lateral face in the range from 1% to 10% of a thickness of the conductor.

19. The electrical contact according to claim 16, wherein the groove has two lateral faces, the lateral faces being arranged transversely relative to the longitudinal direction of the conductor, the lateral faces having different inclinations, the lateral face which is associated with the web having a shallower inclination defining a flatter lateral face and an opposing steeper lateral face.

20. The electrical contact according to claim 19, wherein the flatter lateral face has a larger width than the steeper lateral face.

21. The electrical contact according to claim 16, wherein lateral faces of the groove have an opening angle between 50° and 80°, in a plane perpendicular relative to the groove.

22. The electrical contact according to claim 21, wherein lateral faces of the groove have an opening angle of approximately 65°, in a plane perpendicular relative to the groove.

* * * * *